US008095053B2

(12) United States Patent
Hara et al.

(10) Patent No.: US 8,095,053 B2
(45) Date of Patent: Jan. 10, 2012

(54) TRANSFER BELT UNIT FOR IMAGE FORMING APPARATUS INCLUDING A STEERING ROLLER TO CORRECT MEANDERING

(75) Inventors: Kazuhiro Hara, Numazu (JP); Takeru Murofushi, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 449 days.

(21) Appl. No.: 12/101,835

(22) Filed: Apr. 11, 2008

(65) Prior Publication Data

US 2008/0260424 A1 Oct. 23, 2008

Related U.S. Application Data

(60) Provisional application No. 60/912,202, filed on Apr. 17, 2007, provisional application No. 60/957,695, filed on Aug. 23, 2007, provisional application No. 60/957,697, filed on Aug. 23, 2007.

(51) Int. Cl.
*G03G 15/16* (2006.01)

(52) U.S. Cl. ..... 399/302; 399/308

(58) Field of Classification Search ..... 399/302, 399/303, 312, 308, 313
See application file for complete search history.

(56) References Cited

U.S. PATENT DOCUMENTS

| | | | | | |
|---|---|---|---|---|---|
| 5,196,893 | A | * | 3/1993 | Nishise et al. | 399/279 |
| 6,039,663 | A | * | 3/2000 | Eum | 474/103 |
| 6,055,396 | A | * | 4/2000 | Pang | 399/302 |
| 6,104,899 | A | * | 8/2000 | Hokari et al. | 399/165 |
| 6,167,229 | A | * | 12/2000 | Watanabe et al. | 399/313 |
| 7,239,828 | B2 | | 7/2007 | Ito | |
| 7,389,068 | B2 | | 6/2008 | Ito | |
| 2007/0041754 | A1 | * | 2/2007 | Hachisuga et al. | 399/302 |

FOREIGN PATENT DOCUMENTS

| | | | | |
|---|---|---|---|---|
| CN | 1598705 | A | | 3/2005 |
| JP | 63300260 | A | * | 12/1988 |
| JP | 04-133931 | | | 7/1992 |
| JP | 2000-130523 | | | 5/2000 |
| JP | 2000272772 | A | * | 10/2000 |
| JP | 2001080783 | A | * | 3/2001 |
| JP | 2002182482 | A | * | 6/2002 |

OTHER PUBLICATIONS

Chinese Office Action dated Dec. 18, 2009, Chinese Application No. 2008-10090470.6 with English translation, [no English translation].

* cited by examiner

*Primary Examiner* — Quana M Grainger
(74) *Attorney, Agent, or Firm* — Patterson & Sheridan, LLP

(57) ABSTRACT

In the transfer belt unit according to an embodiment of the present invention, rotation of a rear-side detection roller or a front-side detection roller rotated in contact with ribs of a transfer belt is transmitted to a steering roller via a lead screw to tilt the steering roller and control meandering of the transfer belt.

17 Claims, 12 Drawing Sheets

TRANSFER BELT UNIT FOR IMAGE FORMING APPARATUS INCLUDING A STEERING ROLLER TO CORRECT MEANDERING

CROSS REFERENCE TO RELATED APPLICATION

This invention is based upon and claims the benefit of priority from prior U.S. Patent Applications 60/912,202 filed on Apr. 17, 2007, 60/957,695 filed on Aug. 23, 2007, and 60/957,697 filed on Aug. 23, 2007, the entire contents of which are incorporated herein by reference.

BACKGROUND OF THE INVENTION

1. Field of the Invention

The present invention relates to an endless belt mounted on an image forming apparatus, and, more particularly to a transfer belt unit for an image forming apparatus that controls an endless belt not to meander when the endless belt travels.

2. Description of the Related Art

In image forming apparatuses such as a multi function peripheral (MFP) and a printer of a tandem system, toner images of plural colors are transferred onto a transfer belt one after another to form a color toner image. In the tandem system, when the transfer belt meanders, an image quality of the color toner image is extremely deteriorated because of color drift. Therefore, there have been devices for correcting meandering of a transfer belt. As one of such devices, for example, Japanese Patent No. 2868879 discloses a belt driving device that tilts a steering roller, which switches a traveling direction of a transfer belt, according to a balance between an elastic force of a spring and torque of guide rollers on both sides of the steering roller.

However, since the elastic force of the spring is used for the movement of the steering roller, the device in the past is low in speed and reliability and is not suitable for mounting on high-performance and high-speed MFP and the like that are required to realize a high image quality.

Therefore, it is desired to develop a transfer belt unit for an image forming apparatus that can reset, when a transfer belt meanders, the transfer belt in a normal direction at high speed to thereby obtain a high-quality color image without color drift.

SUMMARY OF THE INVENTION

An aspect of the present invention is to quickly and accurately transmit meandering of a transfer belt to a steering roller, correct a traveling direction of the transfer belt to a normal direction, prevent color drift of plural toner images on the transfer belt, and surely obtain a high-quality color toner image.

According to an embodiment of the present invention, there is provided a transfer belt unit including a transfer belt that is rotated to travel while carrying an image, a first detection roller that rotates in contact with a first end in a width direction of the transfer belt, a second detection roller that rotates in contact with a second end opposed to the first end of the transfer belt, a first transmitting portion that transmits the rotation of the first detection roller or the second detection roller, and a steering roller that tilts according to the rotation transmitted by the first transmitting portion and changes a direction of the rotation and traveling of the transfer belt.

DETAILED DESCRIPTION OF THE INVENTION

A first embodiment of the present invention is explained in detail below with reference to the accompanying drawings.

Figure 1:
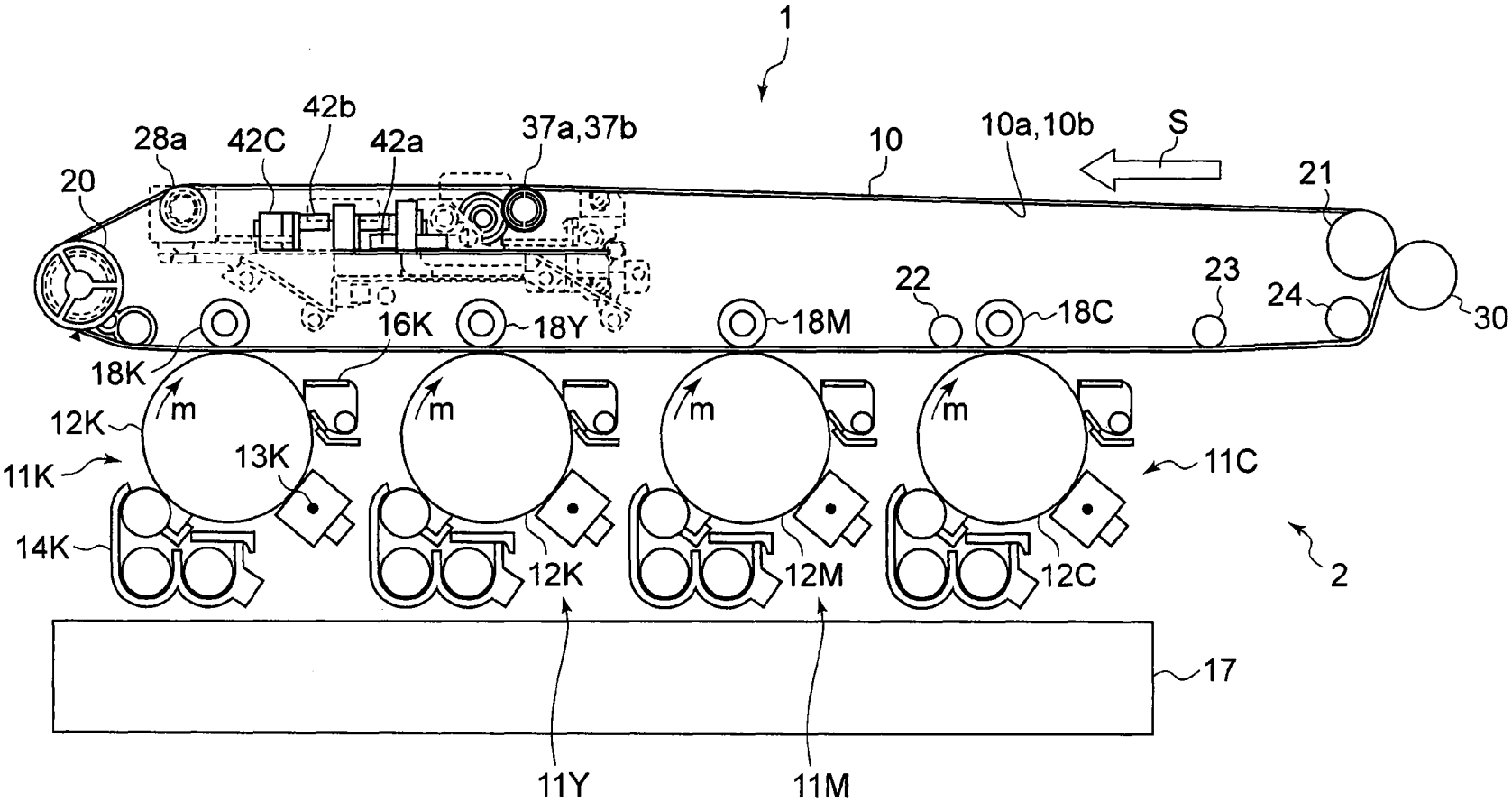
FIG. 1 is a schematic diagram showing a main part of a printer unit according to a first embodiment of the present invention.

FIG. 1 is a schematic diagram showing a main part of a printer unit 2 of a color image forming apparatus of a quadruple tandem system mounted with a transfer belt unit 1 according to the first embodiment. In the printer unit 2, image forming stations 11K, 11Y, 11M, and 11C for respective colors of black (K), yellow (Y), magenta (M), and cyan (C) are arrayed in tandem along a lower side of a transfer belt 10 rotated in an arrow "s" direction. The printer unit 2 includes a laser exposure device 17 that irradiates a laser beam corresponding to image information on photoconductive drums 12K, 12Y, 12M, and 12C of the image forming stations 11K, 11Y, 11M, and 11C for the respective colors.

The image forming station 11K for black (K) of the printer unit 2 is formed by arranging a charger 13K, a developing device 14K, a transfer roller 18K, and a cleaner 16K around the photoconductive drum 12K that rotates in an arrow "m" direction. The image forming stations 11Y, 11M, and 11C for the respective colors of yellow (Y), magenta (M), and cyan (C) have the structure same as that of the image forming station 11K for black (K).

Figure 2:
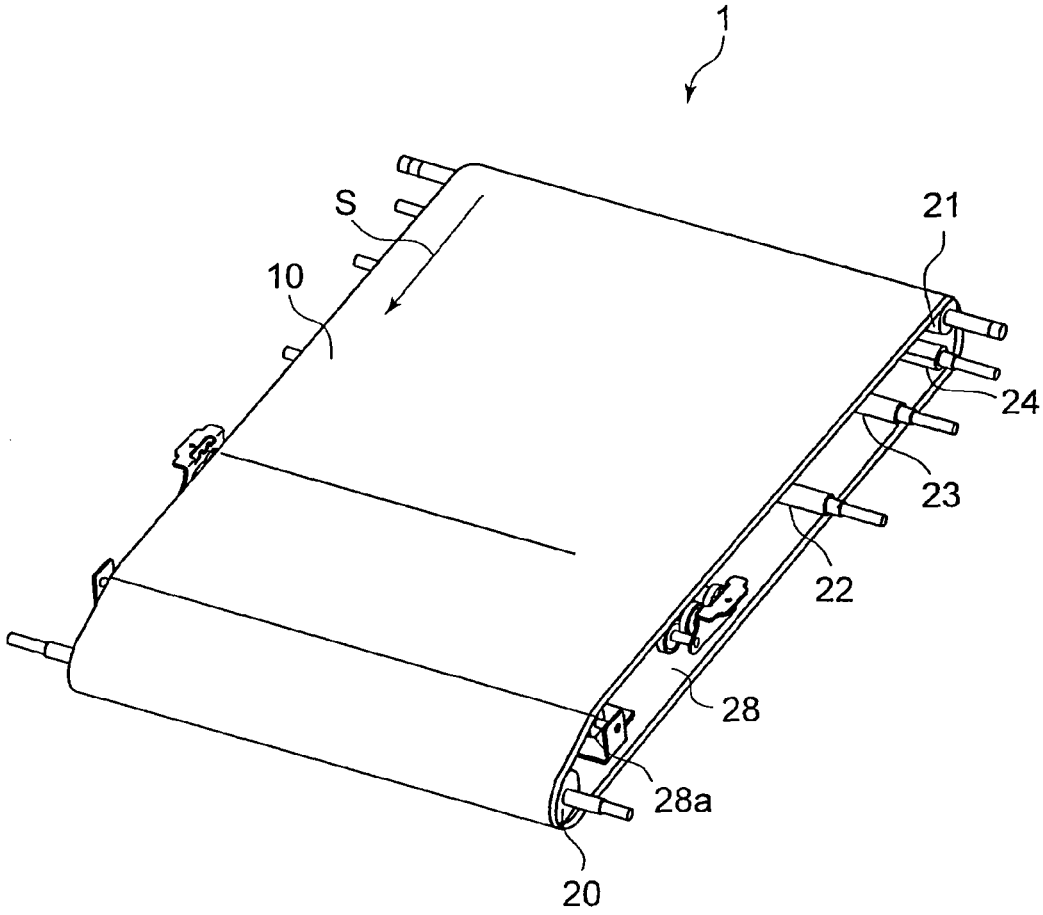
FIG. 2 is a schematic perspective view showing a transfer belt unit according to the first embodiment.
Figure 3:
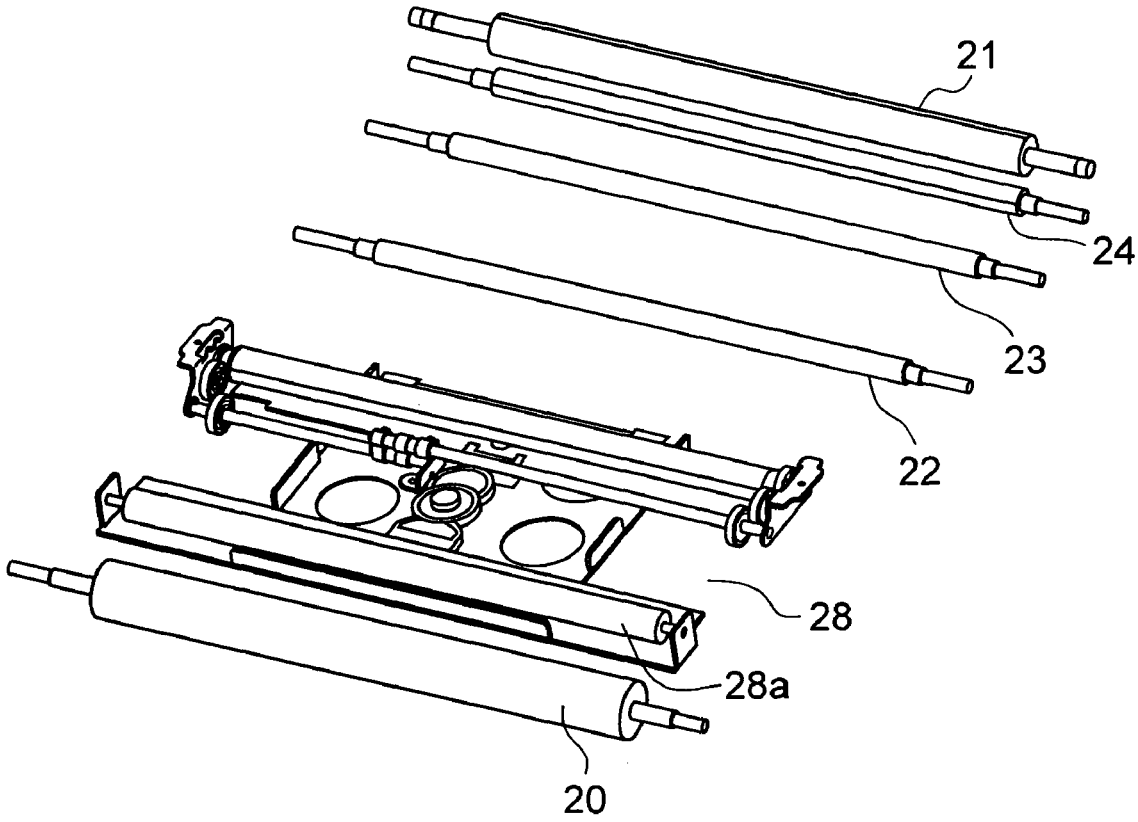
FIG. 3 is a schematic perspective view showing a state in which a transfer belt of the transfer belt unit according to the first embodiment is removed.
Figure 4:
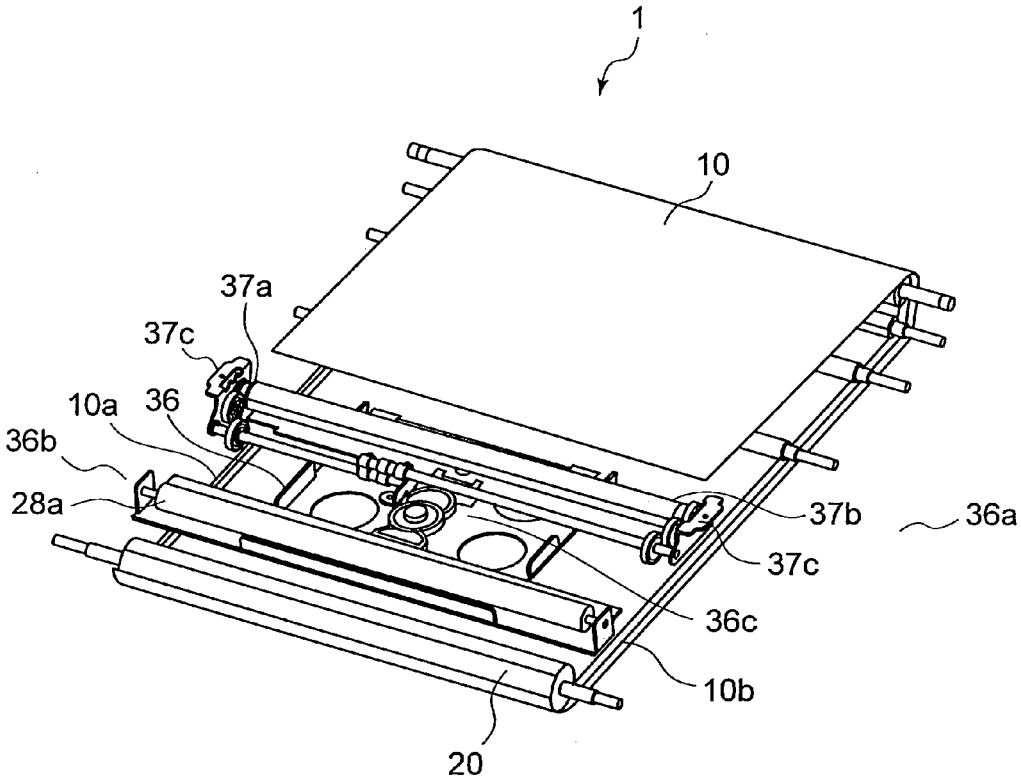
FIG. 4 is a schematic perspective view showing the transfer belt of the transfer belt unit according to the first embodiment with a part thereof cut away.

A fine-line rib 10*a* made of, for example, rubber is formed on an inner periphery of a rear side end, which is a first end in a width direction, of the transfer belt 10 of the transfer belt unit 1. A fine-line rib 10*b* made of, for example, rubber is formed in an inner periphery of a front side end, which is a second end of the transfer belt 10. As shown in FIGS. 2 and 3, the transfer belt 10 is stretched and suspended by a driving roller 20, a driven roller 21, first to third tension rollers 22 to 24, and a steering roller 28*a* of a self-steering mechanism 28. A secondary transfer roller 30 is arranged to be opposed to the driven roller 21 of the transfer belt 10 in a secondary transfer position where the transfer belt 10 is supported by the driven roller 21. In the secondary transfer position, a toner image on the transfer belt 10 is secondarily transferred onto sheet paper P or the like by a transfer bias supplied by the secondary transfer roller 30. The structure of the transfer belt unit 1 is not limited to this.

In the printer unit 2, according to the start of print operation, the photoconductive drum 12K is rotated in an arrow "m" direction and uniformly charged by the charger 13K in the image forming station 11K for black (K). Subsequently, exposure light corresponding to image information is irradiated on the photoconductive drum 12K by the laser exposure device 17 and an electrostatic latent image is formed thereon. Thereafter, a toner image is formed on the photoconductive drum 12K by the developing device 14K. The toner image on the photoconductive drum 12K is primarily transferred onto the transfer belt 10 rotated in an arrow "s" direction in the position of the transfer roller 18K. After the primary transfer is finished, a residual toner is cleaned from the photoconductive drum 12K by a cleaner 16K and the photoconductive drum 12K is available for the next printing.

The image forming stations 11Y, 11M, and 11C for the respective colors of yellow (Y), magenta (M), and cyan (C) perform image forming operation in the same manner as the image forming station 11K for black (K). Respective toner images of yellow (Y), magenta (M), and cyan (C) formed by the respective image forming stations 11Y, 11M, and 11C for yellow (Y), magenta (M), and cyan (C) are primarily transferred onto the transfer belt 10 one after another. Consequently, a full color toner image formed by multiply transferring the toner images of black (K), yellow (Y), magenta (M), and cyan (C) is formed on the transfer belt 10.

The full color toner image superimposed on the transfer belt 10 thereafter reaches the secondary transfer position and is secondarily transferred on the sheet paper P at a time by a transfer bias of the secondary transfer roller 30. The sheet paper P is fed to the secondary transfer position in synchronization with timing when the full color toner image on the transfer belt 10 reaches the secondary transfer position. Thereafter, the sheet paper P having the full color toner image transferred thereon undergoes fixing to have a print image completed thereon and is discharged to a paper discharge unit.

The self-steering mechanism 28 is described in detail. As shown in FIGS. 4, 5A, 5B, and 6, a supporting plate 36 supports a detecting unit 36*a* having a rear-side detection roller 37*a* as a first detection roller and a front-side detection roller 37*b* as a second detection roller, which detect meandering of the transfer belt 10, and a steering unit 36*b* having the steering roller 28*a*. The supporting plate 36 supports a link unit 36*c* as a first transmitting portion that transmits the rotation of each of the rear-side detection roller 37*a* and the front-side detection roller 37*b* to the steering roller 28*a* and a stay 37*c*.

Figure 6:
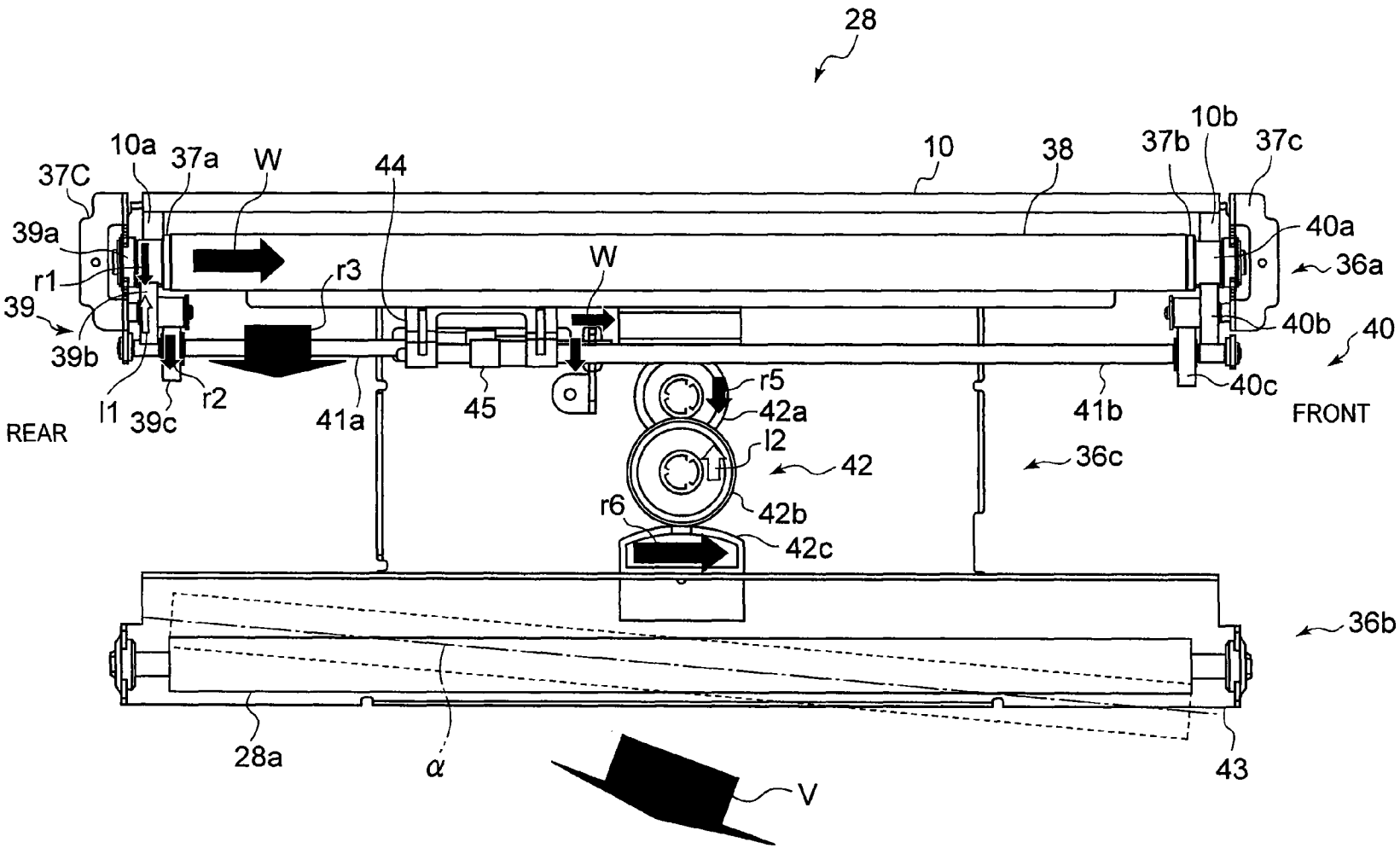
FIG. 6 is a schematic explanatory view showing the self-steering mechanism at the time when the transfer belt according to the first embodiment deviates to the front.
Figure 7:
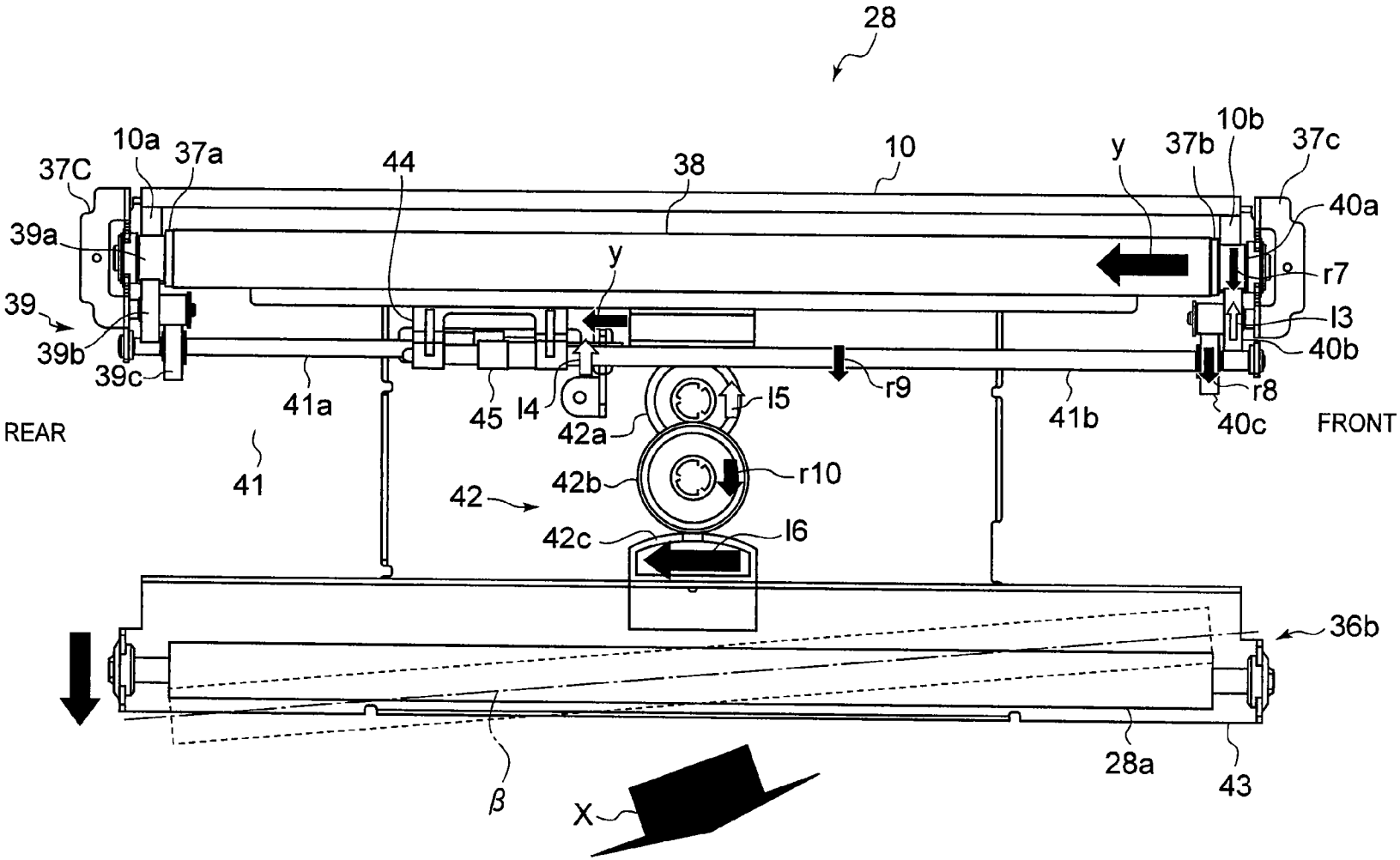
FIG. 7 is a schematic explanatory view showing the self-steering mechanism at the time when the transfer belt according to the first embodiment deviates to the rear.

In the detecting unit 36*a*, a detection roller shaft 38 as a detection roller supporting member has the rear-side detection roller 37*a* and the front-side detection roller 37*b* on both sides thereof. The detection roller shaft 38 is supported by the stay 37*c*. When the transfer belt 10 is held in a normal position, the rear-side detection roller 37*a* and the front-side detection roller 37*b* are spaced apart from the ribs 10*a* and 10*b* of the transfer belt 10. When the transfer belt 10 meanders to the front as shown in FIG. 6, the rear-side detection roller 37*a* comes into contact with the inner side of the rib 10*a* on the rear side. When the transfer belt 10 meanders to the rear as shown in FIG. 7, the front-side detection roller 37*b* comes into contact with the inner side of the rib 10*b* on the front side. The rear-side detection roller 37*a* and the front-side detection roller 37*b* are free from the detection roller shaft 38 and are rotated by contact with the ribs 10*a* and 10*b* of the transfer belt 10, respectively.

Figure 5A:
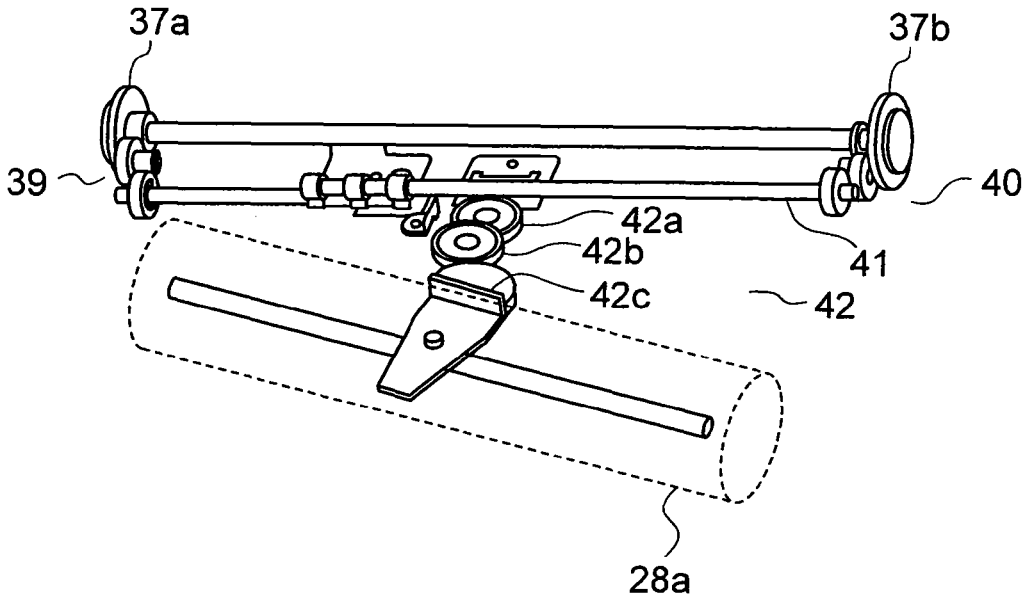
FIG. 5A is a schematic explanatory view showing a self-steering mechanism according to the first embodiment.
Figure 5B:
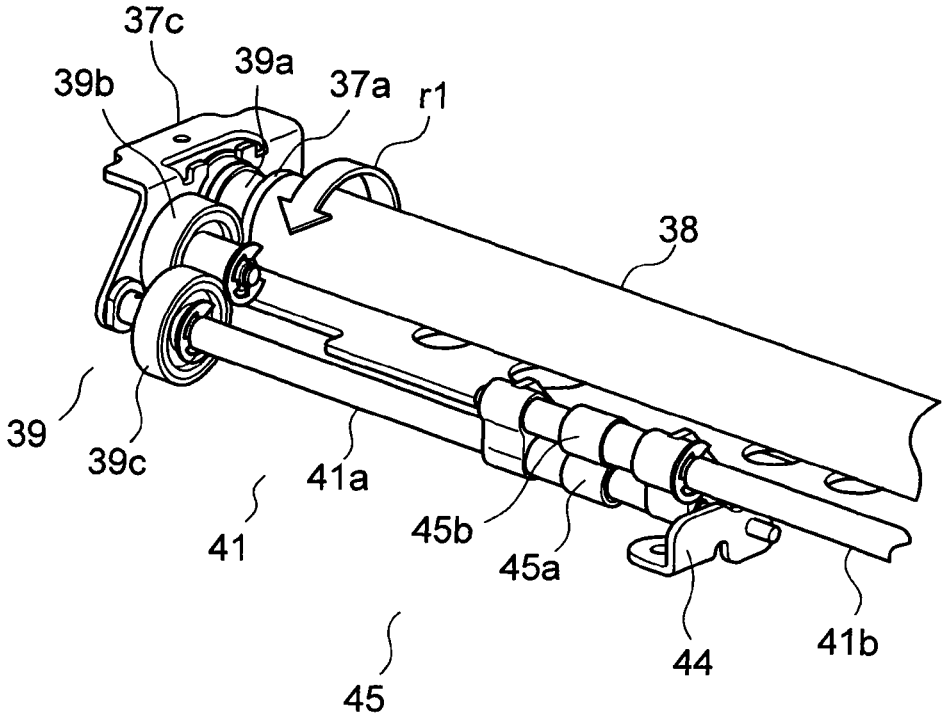
FIG. 5B is a schematic perspective view showing a lead screw according to the first embodiment.

The link unit 36*c* has a rear-side gear unit 39 driven by the rear-side detection roller 37*a* and a front-side gear unit 40 driven by the front-side detection roller 37*b*. The rear-side gear unit 39 has a first rear gear 39*a*, a second rear gear 39*b*, and a third rear gear 39*c*. The front-side gear unit 40 has a first front gear 40*a*, a second front gear 40*b*, and a third front gear 40*c*. The link unit 36*c* has a right-hand lead screw 41 connected to the third rear gear 39*c* and the third front gear 40*c*. The lead screw 41 is formed by a rear-side lead screw 41*a* and a front-side lead screw 41*b* via a reversing gear 45 as a reversing mechanism. As shown in FIG. 5B, the reversing gear 45 has a rear-side reversing gear 45*a* and a front-side reversing gear 45*b*. The reversing gear 45 reverses the rotation of the third front gear 40*c* and transmits the rotation to the stay 37*c* and the steering unit 36*b*. The rear-side lead screw 41*a* is in mesh with an inner periphery of a bracket 44 of the stay 37*c*.

The rear-side lead screw 41*a* meshes with a first gear 42*a* of a rack pinion mechanism 42. The rack pinion mechanism 42 has a first gear 42*a*, a second gear 42*b* that meshes with the first gear 42*a*, and a third gear 42*c* that meshes with the second gear 42*b*. The third gear 42*c* rotates a steering supporting member 43. The steering roller 28*a* supported by the steering supporting member 43 is tilted with respect to a shaft by the rotation of the steering supporting member 43.

According to the rotation of the rear-side lead screw 41*a*, the link unit 36*c* slides the stay 37*c* in a width direction of the transfer belt 10 via the bracket 44.

Actions of the self-steering mechanism 28 are described. While print operation is performed in the printer unit 2, the self-steering mechanism 28 is not actuated when the transfer belt 10 rotates and travels in a normal position without meandering. On the other hand, while the print operation is performed, when the transfer belt 10 meanders, the self-steering mechanism 28 detects the meandering of the transfer belt 10, tilts the steering roller 28*a*, and corrects a traveling direction of the transfer belt 10.

A tilt of the steering roller 28*a*, for example, at the time when the transfer belt 10 meanders to the front is explained with reference to FIG. 6. Rotating directions of the respective gears described here are rotating directions viewed from the rear side. 1/When the transfer belt 10 deviates to the front side, the rib 10*a* on the rear side of the transfer belt 10 comes into contact with the rear-side detection roller 37*a*. 2/Consequently, the rear-side detection roller 37*a* of the detecting unit 36*a* rotates, for example, to the right following the rib 10*a* on the rear side.

3/The rotation of the rear-side detection roller 37*a* is transmitted to the steering unit 36*b* by the link unit 36*c* and tilts the steering roller 28*a*. According to the rotation of the rear-side detection roller 37*a*, the first rear gear 39*a* coaxial with the rear-side detection roller 37*a* rotates to the right (r1), the second rear gear 39*b* rotates to the left (l1), and the third rear gear 39*c* rotates to the right (r2). Consequently, the rear-side lead screw 41*a* connected to the third rear gear 39*c* also rotates to the right (r3). The right rotation (r3) of the right-hand right-side lead screw 41*a* is transmitted to the rack pinion mechanism 42. The right rotation (r3) rotates the first gear 42*a* to the right (r5), rotates the second gear 42*b* to the left (l2), and rotates the third gear 42*c* to the right (r6).

4/The steeling supporting member 43 and the steering roller 28*a* supported by the steeling supporting member 43 are tilted in an arrow "v" direction by the right rotation (r6) of the third gear 42*c*. In the transfer belt 10, a force for conveying the belt in a direction perpendicular to an axis α of the steering roller 28*a* tilted as indicated by a dotted line in FIG. 6 is generated. Consequently, the transfer belt 10 has a traveling direction thereof corrected to deviate to the rear.

An angle of the tilt of the steering roller 28*a* for correcting the traveling direction of the transfer belt 10 is not limited. However, in this embodiment, for example, even when the transfer belt 10 shifts ±1 mm from the center in design, it is possible to correct the traveling direction to a normal direction by tilting the steering roller 28*a* ±3° at the maximum.

When the traveling direction of the transfer belt 10 is corrected to the normal direction according to the tilt of the steering roller 28*a*, the rib 10*a* on the rear side of the transfer belt 10 separates from the rear-side detection roller 37*a* and the rear-side detection roller 37*a* is stopped. However, after the rotation of the steering roller 28*a*, there is a time lag until the traveling direction of the transfer belt 10 is corrected. During the time lag, when the rear-side detection roller 37*a* is rotating, the steering roller 28*a* over-rotates. As a result, the transfer belt 10 deviates to the rear side. Thus, the rear-side detection roller 37*a* is moved in the width direction of the transfer belt 10 by the rotation of the rear-side detection roller 37*a*. Therefore, before the traveling direction of the transfer belt 10 is corrected, the rear-side detection roller 37*a* can separate from the transfer belt 10. As a result, the steering roller 28*a* is prevented from over-rotating.

Figure 8:
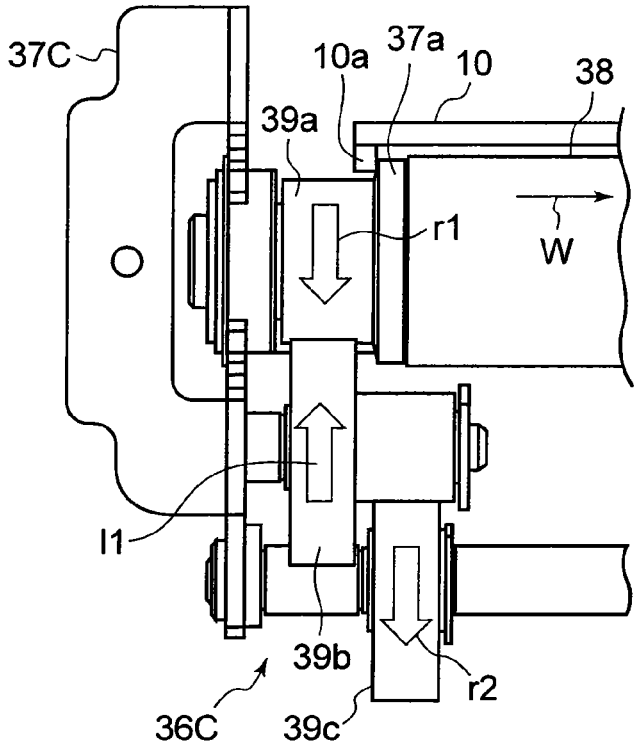
FIG. 8 is a schematic explanatory view showing a state in which a rear-side rib is in contact with a rear-side detection roller according to the first embodiment.
Figure 9:
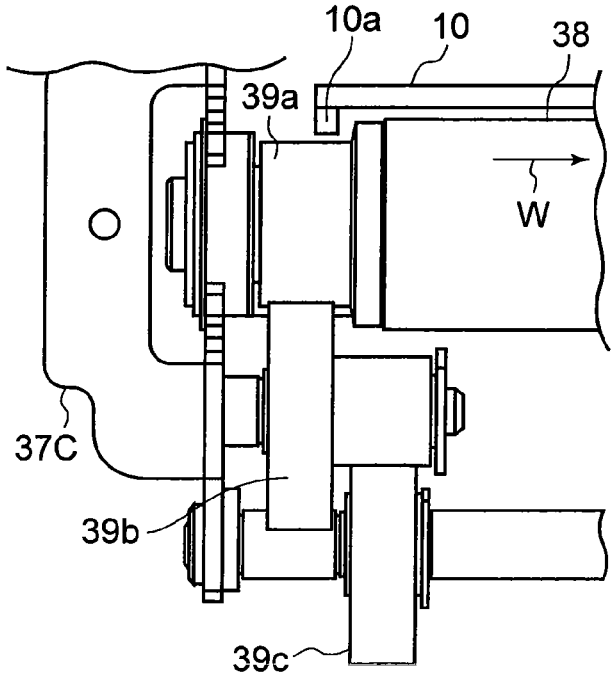
FIG. 9 is a schematic explanatory view showing a state in which the rear-side detection roller according to the first embodiment is spaced apart from the rear-side rib.

An action for stopping the rear-side detection roller 37*a* according to the driving of the link unit 36*c* is described. 1/As shown in FIG. 8, the link unit 36*c* is driven by the rotation of the rear-side detection roller 37*a* due to contact with the rib 10*a* of the transfer belt 10. 2/At this point, the right-hand rear-side lead screw 41*a* of the link unit 36*c* is rotating to the right (r3). Therefore, the bracket 44 that meshes with the rear-side lead screw 41*a* is moved in an arrow "w" direction in FIG. 6, which is a front direction, and moves the stay 37*c* in the arrow "w" direction. Consequently, the rear-side detection roller 37*a* supported by the stay 37*c* via the detection roller shaft 38 moves in the arrow "w" direction as shown in FIG. 9. As a result, the rear-side detection roller 37*a* separates from the rear-side rib 10*a* of the transfer belt 10 and stops.

However, when the tilt of the steering roller 28*a* is insufficient, the rib 10*a* on the rear side comes into contact with the rear-side detection roller 37*a* again. Consequently, the rear-side detection roller 37*a* is rotated again and further tilts the steering roller 28*a*. As the rear-side detection roller 37*a* further separates from the rear-side rib 10*a*, a force of contact of the rear-side rib 10*a* with the rear-side detection roller 37*a* weakens. Consequently, a rotation amount of the rear-side detection roller 37*a* is reduced. By repeating the rotation and the stop of the rear-side detection roller 37*a*, the transfer belt 10 has the traveling direction thereof corrected and is controlled not to meander and stably rotated to travel.

The tilt of the steering roller 28*a* at the time when the transfer belt 10 meanders to the rear is explained with reference to FIG. 7. Rotating directions of the respective gears described here are rotating directions viewed from the rear side. 1/When the transfer belt 10 deviates to the rear side, the inner side of the rib 10*b* on the front side of the transfer belt 10 comes into contact with the front-side detection roller 37*b*. 2/Consequently, the front-side detection roller 37*b* of the detecting unit 36*a* rotates to the right following the rib 10*b* on the front side.

3/According to the right rotation of the front-side detection roller 37*b*, the first front gear 40*a* coaxial with the front-side detection roller 37*b* rotates to the right (r7), the second front gear 40*b* rotates to the left (l3), and the third front gear 40*c* rotates to the right (r8). Consequently, the right rotation (r9) is also transmitted to the front-side lead screw 41*b* connected to the third front gear 40*c*. The right rotation (r9) of the front-side lead screw 41*b* rotates the rear-side lead screw 41*a* to the left (l4) via the reversing gear 45. The left rotation (l4) of the rear-side lead screw 41*a* is transmitted to the rack pinion mechanism 42. The left rotation (l4) rotates the first gear 42*a* to the left (l5), rotates the second gear 42*b* to the right (r10), and rotates the third gear 42*c* to the left (l6).

4/The steering supporting member 43 and the steering roller 28*a* supported by the steering supporting member 43 are tilted in an arrow "x" direction by the left rotation (l6) of the third gear 42*c*. In the transfer belt 10, a force for conveying the belt in a direction perpendicular to an axis β of the steering roller 28*a* tilted as indicated by a dotted line in FIG. 7 is generated. Consequently, the transfer belt 10 has the traveling direction thereof corrected to deviate to the front.

At this point, the bracket 44 that meshes with the rear-side lead screw 41*a* is moved in an arrow "y" direction in FIG. 7, which is a rear direction, by the rear-side lead screw 41*a* rotated to the left (l4) and moves the stay 37*c* in the arrow "y" direction. Consequently, the front-side detection roller 37*b* supported by the stay 37*c* via the detection roller shaft 38 moves in the arrow "y" direction, separates from the front-side rib 10*b* of the transfer belt 10, and stops. Thereafter, as at the time when the transfer belt 10 deviates to the front side, by repeating the rotation and the stop of the front-side detection roller 37*b*, the transfer belt 10 has the traveling direction thereof corrected and is controlled not to meander and stably rotated to travel.

In the first embodiment, the rear-side detection roller 37*a* and the front-side detection roller 37*b* are rotated free from the detection roller shaft 38. The lead screw 41 has the reversing gear 45 in order to reverse the driving of the steering roller 28*a* and the stay 37*c* when the rear-side detection roller 37*a* rotates and when the front-side detection roller 37*b* rotates. Therefore, the rear-side detection roller 37*a* and the front-side detection roller 37*b* rotate in opposite directions according to whether the ribs 10*a* and 10*b* of the transfer belt 10 come into contact therewith.

Figure 10:
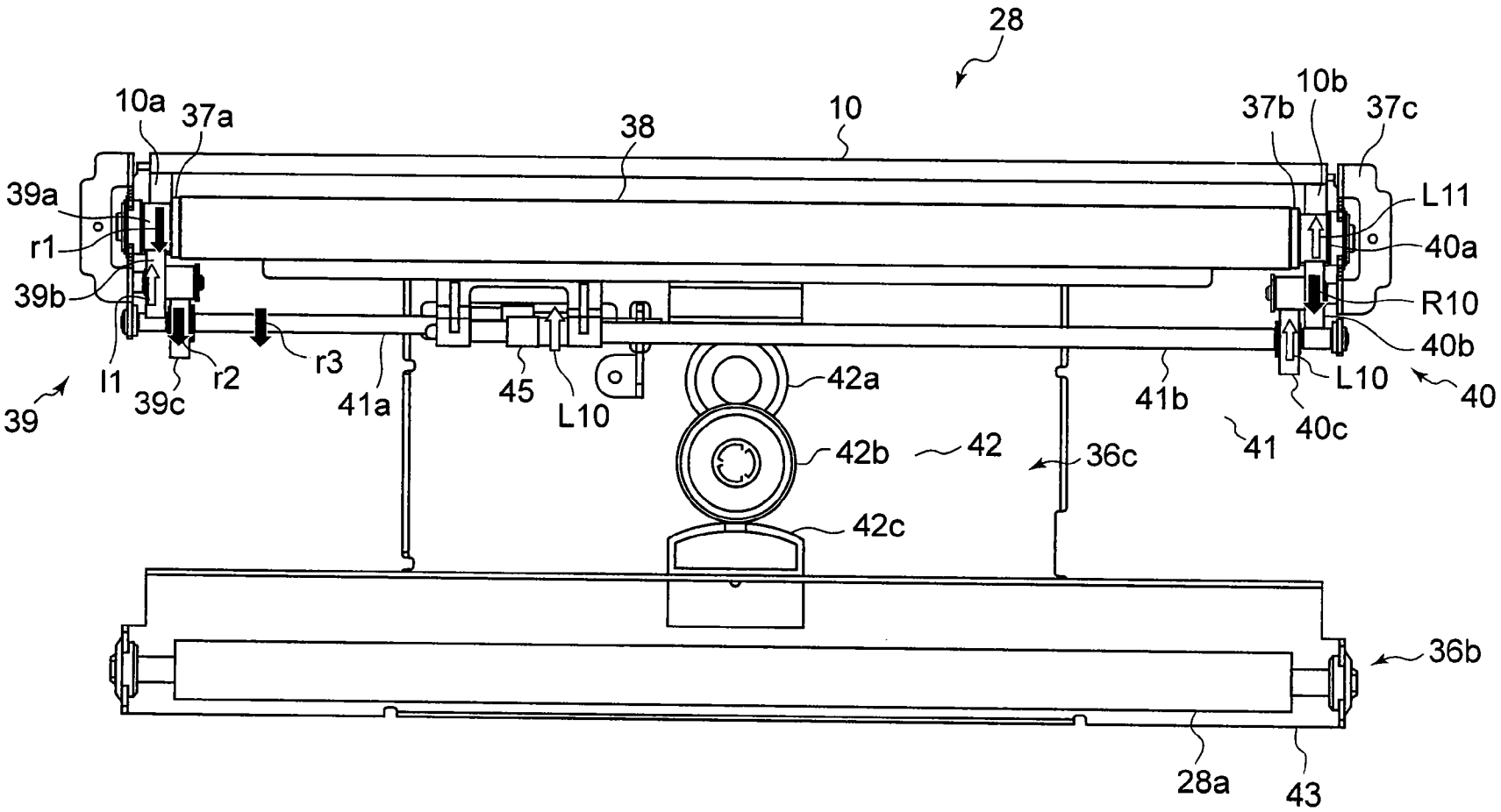
FIG. 10 is a schematic explanatory view showing a rotating direction of the rear-side detection roller at the time when the rear-side detection roller is rotated by the transfer belt according to the first embodiment.

For example, when the rib 10*a* on the rear side comes into contact with the rear-side detection roller 37*a*, the rear-side detection roller 37*a* and the front-side detection roller 37*b* rotate in opposite directions as shown in FIG. 10. According to the right rotation of the rear-side detection roller 37*a*, the first rear gear 39*a* rotates to the right (r1), the second rear gear 39*b* rotates to the left (l1), and the third rear gear 39*c* rotates to the right (r2). The rear-side lead screw 41*a* rotates to the right (r3). Since the front-side lead screw 41*b* is reversely rotated by the reversing gear 45, the third front gear 40*c* is rotated to the left (L10). Therefore, the second front gear 40*b* rotates to the right (R10), the first front gear 40*a* rotates to the left (L11), and the front-side detection roller 37*b* rotates to the left (L11) opposite to the rear-side detection roller 37*a*.

According to this embodiment, meandering of the transfer belt 10 is detected by the rear-side detection roller 37*a* or the front-side detection roller 37*b* that comes into contact with the rib 10*a* or 10*b* of the transfer belt 10 to be rotated. The rotation of the rear-side detection roller 37*a* or the front-side detection roller 37*b* is transmitted to the steering roller 28*a* via the right-hand rear-side lead screw 41*a* to tilt the steering roller 28*a*, whereby a direction of the rotation and traveling of the transfer belt 10 is corrected. Moreover, the rotation of the rear-side detection roller 37*a* or the front-side detection roller 37*b* is transmitted to the stay 37*c* via the right-hand rear-side lead screw 41*a* and, then, the rear-side detection roller 37*a* or the front-side detection roller 37*b* is immediately separated from the rib 10*a* or 10*b* of the transfer belt 10. Therefore, according to the first embodiment, since expensive and complicated control and mechanisms are unnecessary, it is possible to easily and surely control meandering of the transfer belt. As a result, it is possible to stably rotate the transfer belt to travel and it is possible to obtain a satisfactory transfer image.

A second embodiment of the present invention is explained. The second embodiment is different from the first embodiment in the structure of the transfer belt. In the second embodiment, detection of meandering of the transfer belt on the rear side and the front side are opposite to that in the first embodiment. Therefore, in the second embodiment, the structure of the first transmitting portion is different from that in the first embodiment. Otherwise, the second embodiment is the same as the first embodiment. Therefore, in the second embodiment, components identical with those explained in the first embodiment are denoted by the identical reference numerals and signs and detailed explanation of the components is omitted.

Figure 11:
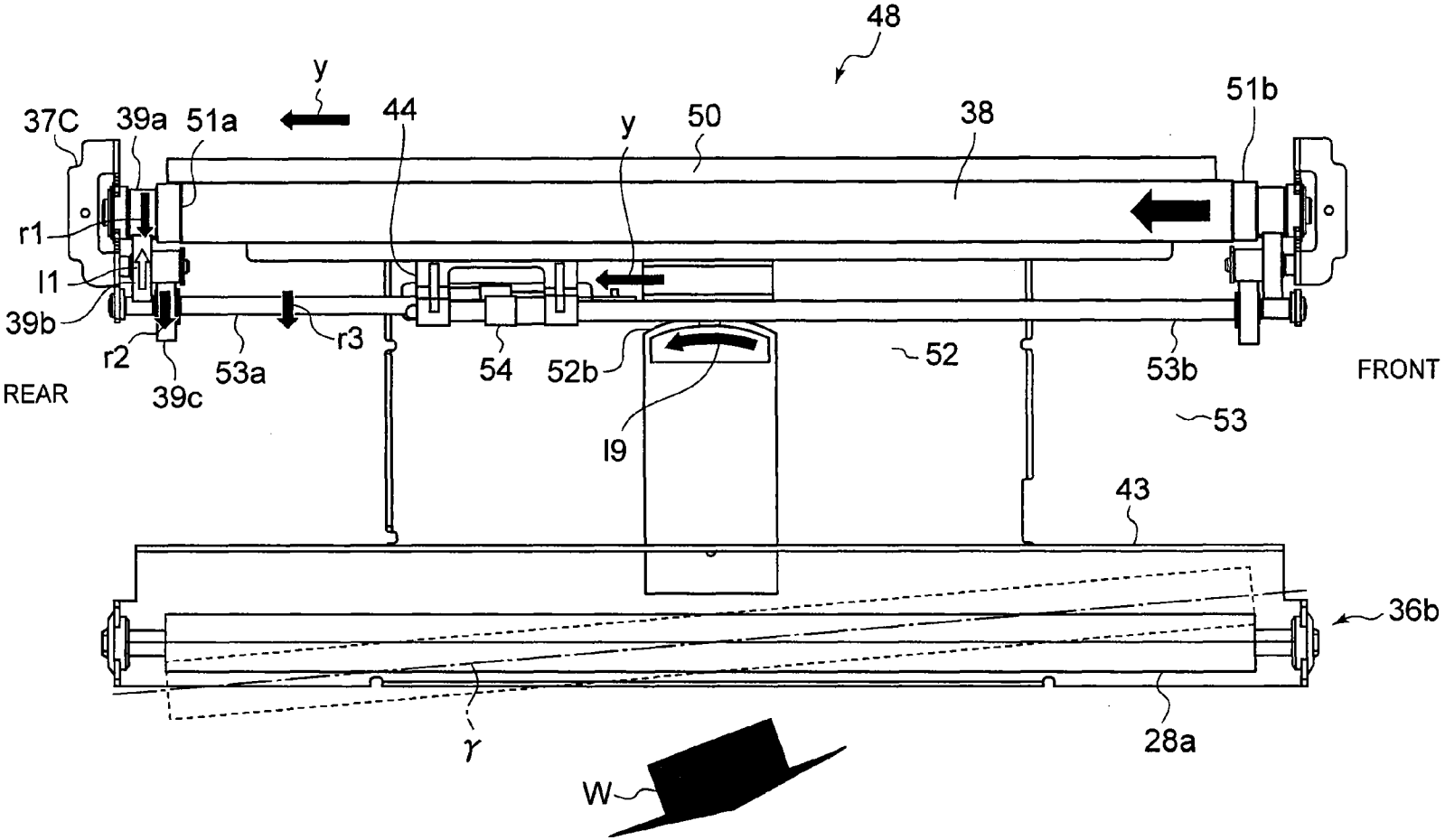
FIG. 11 is a schematic explanatory view showing a self-steering mechanism according to a second embodiment of the present invention.

As shown in FIG. 11, a self-steering mechanism 48 according to the second embodiment controls meandering of a transfer belt 50 that does not have ribs at both ends of an inner periphery thereof. When the transfer belt 50 is held in a normal position, both ends of the transfer belt 50 are spaced apart from a rear-side detection roller 51*a* and a front-side detection roller 51*b*. When the transfer belt 50 meanders and comes into contact with a roller surface of the rear-side detection roller 51*a* or the front-side detection roller 51*b*, the rear-side detection roller 51*a* or the front-side detection roller 51*b* is rotated. A rotation amount of the rear-side detection roller 51*a* and the front-side detection roller 51*b* is adjusted according to an area of contact between the transfer belt 50 and roller surfaces of the rollers. Therefore, the width of the roller surfaces of the rear-side detection roller 51*a* and the front-side detection roller 51*b* is formed to be at least equal to or larger than the width equivalent to a maximum meandering amount of the transfer belt 50. The rack pinion mechanism 52 has a fifth gear 52*b* that meshes with a left-hand lead screw 53. The left-hand lead screw 53 has a rear-side lead screw 53*a* and a front-side lead screw 53*b* via a reversing gear 54. The bracket 44 is in mesh with the rear-side lead screw 53*a*.

In the self-steering mechanism 48, for example, when the transfer belt 50 meanders to the rear, 1/an inner periphery of a rear-side end of the transfer belt 50 comes into contact with the roller surface of the rear-side detection roller 51*a*. 2/Consequently, the rear-side detection roller 51*a* rotates following the transfer belt 50. The rotation of the rear-side detection roller 51*a* is transmitted to the rear-side lead screw 53*a* via the rear-side gear unit 39 as in the first embodiment. However, since the lead screw 53 is a left-hand screw, the rear-side lead screw 53 rotated to the right (r3) rotates the fifth gear 52*b* to the left (l9).

4/The steering supporting member 43 and the steering roller 28*a* supported by the steering supporting member 43 are tilted in the arrow "w" direction by the left rotation (l9) of the fifth gear 52*b*. In the transfer belt 50, a force for conveying the belt in a direction perpendicular to an axis y of the steering roller 28*a* tilted as indicated by a dotted line in FIG. 11 is generated. Consequently, the transfer belt 50 has a traveling direction thereof corrected to deviate to the front.

While the traveling direction of the transfer belt 50 is corrected, the bracket 44 that meshes with the left-hand rear-side lead screw 53*a* is moved in the arrow "y" direction, which is the rear direction, and moves the stay 37*c* in the arrow "y" direction. Consequently, the rear-side detection roller 51*a* supported by the stay 37*c* via the detection roller shaft 38 moves in the arrow "y" direction. As a result, the rear-side detection roller 51*a* separates from the transfer belt 50 and stops.

A tilt in the arrow "v" direction of the transfer belt 50 by the rotation of the front-side detection roller 51*b* is performed in the same manner. When the traveling direction of the transfer belt 50 is corrected, the inner periphery of the transfer belt 50 separates from the rear-side detection roller 51*a* and the rear-side detection roller 51*a* stops.

According to this embodiment, as in the first embodiment, it is possible to easily and surely control meandering of the transfer belt and it is possible to obtain a more satisfactory transfer image through stable rotation and traveling of the transfer belt. Moreover, since it is unnecessary to form expensive ribs in the transfer belt, it is possible to realize a reduction in cost of the transfer belt.

In this embodiment, a material of the roller surfaces of the rear-side detection roller or the front-side detection roller is not limited. The roller surfaces may be formed of a material having a high coefficient of friction such as rubber. Consequently, it is possible to secure a sufficient frictional force between the rear-side detection roller or the front-side detection roller and the inner periphery of the transfer belt. As a result, the rear-side detection roller or the front-side detection roller can accurately detect meandering of the transfer belt. Therefore, it is possible to more surely correct the traveling direction of the transfer belt.

A third embodiment of the present invention is explained. The third embodiment is different from the first embodiment in that the detection roller shaft and the rear-side detection roller and the front-side detection roller supported by the detection roller shaft do not move in the width direction of the transfer belt. The third embodiment is also different from the first embodiment in the structure of the first transmitting portion. Otherwise, the third embodiment is the same as the first embodiment. Therefore, in the third embodiment, components identical with those explained in the first embodiment are denoted by the identical reference numerals and signs and detailed explanation of the components is omitted.

Figure 12:
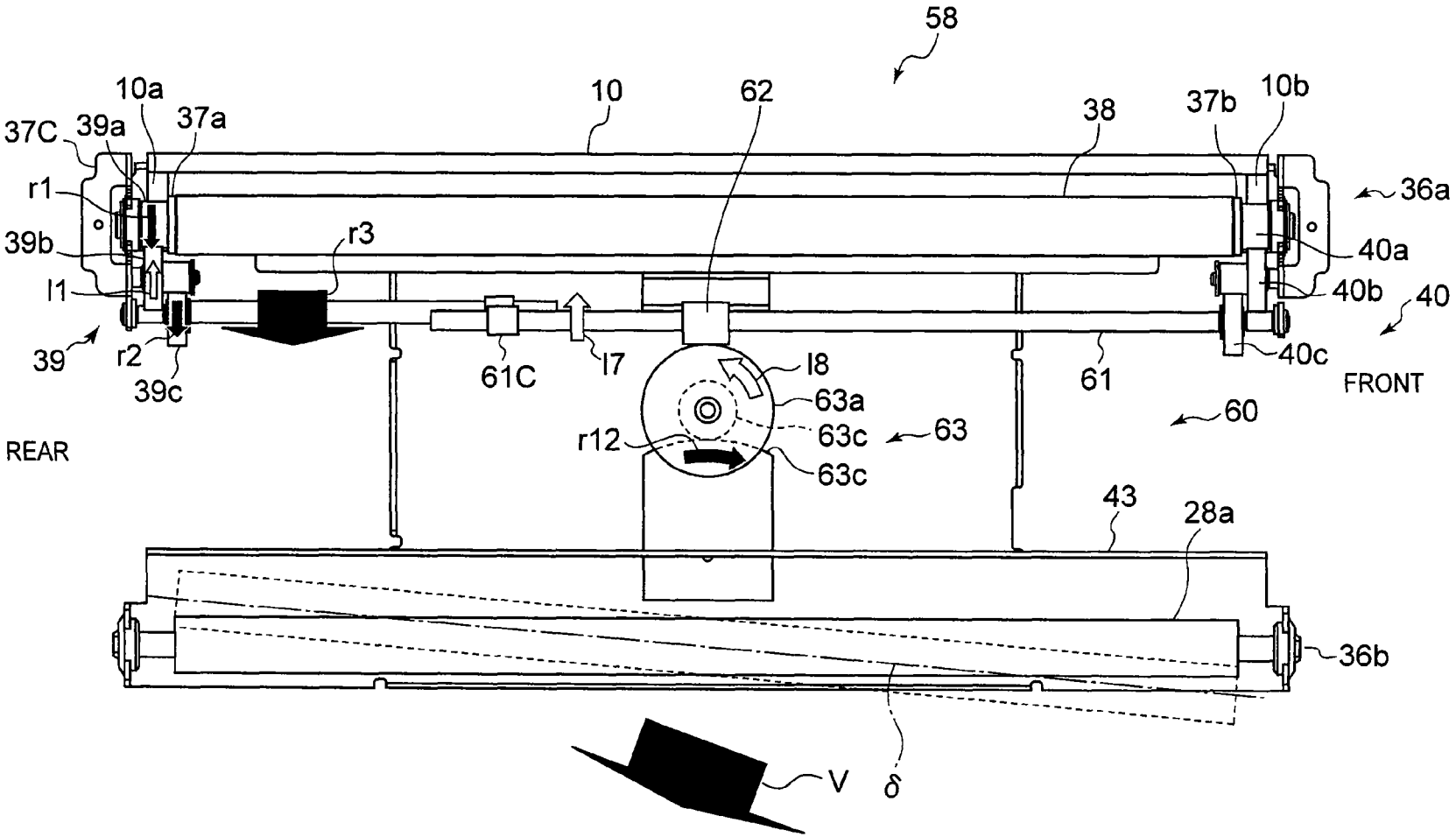
FIG. 12 is a schematic explanatory view showing a self-steering mechanism at the time when a transfer belt according to a third embodiment of the present invention deviates to the front.

As shown in FIG. 12, a self-steering mechanism 58 according to the third embodiment does not have a mechanism for moving the detection roller shaft 38 that supports the rear-side detection roller 37*a* and the front-side detection roller 37*b* in the width direction of the transfer belt 10. A link unit 60 transmits the rotation of each of the rear-side detection roller 37*a* and the front-side detection roller 37*b* to the steering roller 28*a*. The rear-side gear unit 39 and the front-side gear unit 40 of the link unit 60 are linked by a link shaft 61. The link shaft 61 has a reversing gear 61*c* as a reversing mechanism. The reversing gear 61*c* reverses the rotation of the third front gear 40*c* and transmits the rotation to the steering unit 36*b*. A worm 62 is pivotally attached to the link shaft 61. The worm 62 meshes with a worm wheel 63*a* of a rack pinion mechanism 63. The rack pinion mechanism 63 has the worm wheel 63*a*, a seventh gear 63*b* coaxial with the worm wheel 63*a*, and an eighth gear 63*c* that meshes with the seventh gear 63*b*. The eighth gear 63*c* rotates the steering supporting member 43.

A tilt of the steering roller 28*a*, for example, at the time when the transfer belt 10 meanders to the front is explained with reference to FIG. 12. When the transfer belt 10 moves to the front side and the rib 10*a* on the rear side of the transfer belt 10 comes into contact with the rear-side detection roller 37*a*, the rear-side detection roller 37*a* rotates to the right (r1) as in the first embodiment. Consequently, in the rear-side gear unit 39, the third rear gear 39*c* is rotated to the right (r2). The link shaft 61 connected to the third rear gear 39*c* also rotates to the right (r3). The right rotation (r3) of the link shaft 61 is reversed into the left rotation (l7) by the reversing gear 61*c* and, then, transmitted to the rack pinion mechanism 63. The worm 62 that rotates to the left (l7) rotates the worm wheel 63*a* to the left (l8) and rotates the eighth gear 63*c* that meshes with the seventh gear 63*b* coaxial with the worm wheel 63*a* to the right (r12).

The steering supporting member 43 and the steering roller 28*a* supported by the steering supporting member 43 are tilted in the arrow "v" direction by the right rotation (r12) of the eighth gear 63*c*. In the transfer belt 10, a force for conveying the belt in a direction perpendicular to an axis δ of the steering roller 28*a* tilted as indicated by a dotted line in FIG. 12 is generated. Consequently, the transfer belt 10 has the traveling direction thereof corrected and returns close to the rear.

According to the tilt of the steering roller 28*a*, the traveling direction of the transfer belt 10 is corrected to the normal direction and the transfer belt 10 returns close to the rear. Consequently, the rib 10*a* on the rear side of the transfer belt 10 separates from the rear-side detection roller 37*a* and the rear-side detection roller 37*a* is stopped.

Figure 13:
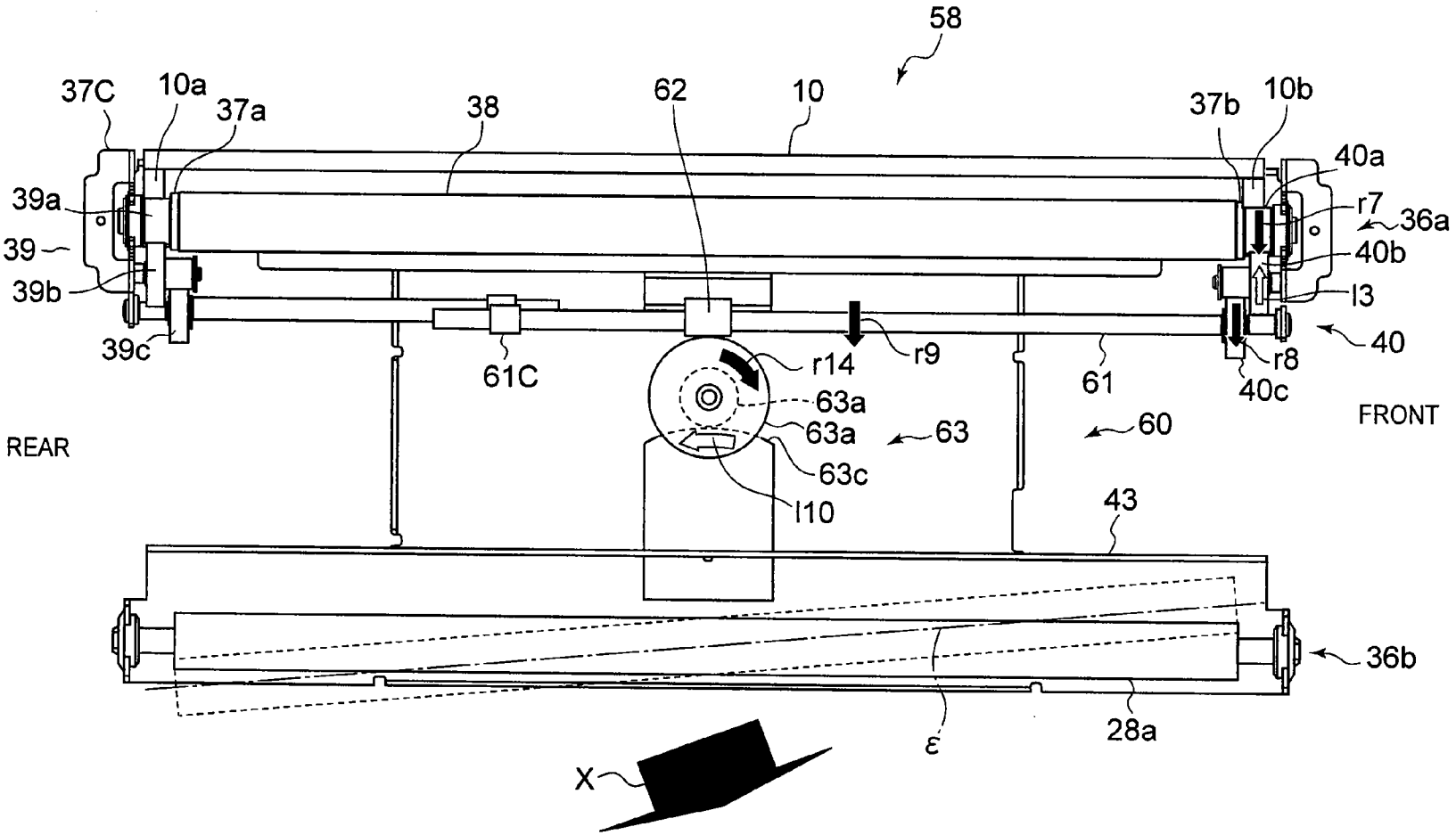
FIG. 13 is a schematic explanatory view showing the self-steering mechanism at the time when the transfer belt according to the third embodiment deviates to the rear.

A tilt of the steering roller 28*a*, for example, at the time when the transfer belt 10 meanders to the rear is explained with reference to FIG. 13. When the transfer belt 10 deviates to the rear and the rib 10*b* on the front side of the transfer belt 10 comes into contact with the front-side detection roller 37*b*, as in the first embodiment, in the front-side gear unit 40, the third front gear 40*c* rotates to the right (r8). Consequently, the link shaft 61 connected to the third front gear 40*c* also rotates to the right (r9). The worm 62 that rotates to the right following the right rotation (r9) of the link shaft 61 rotates the worm wheel 63*a* to the right (r14). The worm 62 rotates the eighth gear 63*c* that meshes with the seventh gear 63*b* coaxial with the worm wheel 63*a* to the left (l10).

The steering supporting member 43 and the steering roller 28*a* supported by the steering supporting member 43 are tilted in the arrow "x" direction by the left rotation (l10) of the eighth gear 63*c*. In the transfer belt 10, a force for conveying the belt in a direction perpendicular to an axis ϵ of the steering roller 28*a* tilted as indicated by a dotted line in FIG. 13 is generated. Consequently, the transfer belt 10 has the traveling direction thereof corrected and returns close to the front.

According to the tilt of the steering roller 28*a*, the traveling direction of the transfer belt 10 is corrected to the normal direction and the transfer belt 10 returns to the front side. Consequently, the rib 10*b* on the front side of the transfer belt 10 separates from the front-side detection roller 37*b* and the front-side detection roller 37*b* is stopped.

According to this embodiment, as in the first embodiment, it is possible to easily and surly control meandering of the transfer belt and obtain a more satisfactory transfer image through stable rotation and traveling of the transfer belt. Moreover, by using the worm 62 and the worm wheel 63*a*, it is possible to simplify the structure of the transmission mechanism for transmitting the rotation of the rear-side detection roller 37*a* or the front-side detection roller 37*b* to the steering roller 28*a* and realize a reduction in cost of the self-steering mechanism 58.

The present invention is not limited to the embodiments described above. Various modifications of the embodiments are possible without departing from the spirit of the present invention. For example, the structure, materials, and the like of the first detection roller or the second detection roller are not limited as long as the first detection roller or the second detection roller can rotate according to contact with the transfer belt. Directions of the screws of the lead screw, areas where the screws are formed, and the like in the first embodiment are not limited either. The structure of the printer unit does not have to be the tandem system. The printer may transfer images on a single image bearing member onto the transfer belt one after another using a revolver-type developing device.

What is claimed is:

1. A transfer belt unit comprising:

a transfer belt that is rotated to travel while carrying an image;

a driving roller configured to rotate the transfer belt;

a first detection roller that rotates when it is in contact with a first end in a width direction of the transfer belt;

a second detection roller that rotates when it is in contact with a second end opposed to the first end of the transfer belt;

a first transmitting portion that includes a lead screw which is rotated according to a rotation of the first detection roller or the second detection roller, and a rack pinion mechanism which is connected to the lead screw and rotated in a direction perpendicular to the rotation of the first detection roller or the second detection roller, and is configured to transmit the rotation of the first detection roller or the second detection roller;

a steering roller that is connected to the rack pinion mechanism and tilted in a traveling direction of the transfer belt, and is configured to change a direction of the rotation and traveling of the transfer belt according to a rotation of the first detection roller or the second detection roller; and a steering supporting member configured to support the steering roller and being tilted in a traveling direction of the transfer belt together with the steering roller.

2. A transfer belt unit according to claim 1, wherein the steering roller gives tension to the transfer belt.

3. A transfer belt unit according to claim 1, wherein the first detection roller is a rear-side detection roller located on a rear side of the transfer belt, the second detection roller is a front-side detection roller located on a front side of the transfer belt, and the rear-side detection roller and the front-side detection roller are freely supported by a detection roller supporting member.

4. A transfer belt unit according to claim 1, wherein the first transmitting portion includes a reversing mechanism that links the rotation of the first detection roller and the rotation of the second detection roller.

5. A transfer belt unit according to claim 3, wherein the steering roller tilts, according to the rotation of the rear-side detection roller, to move the transfer belt to the front side and tilts, according to the rotation of the front-side detection roller, to move the transfer belt to the rear side.

6. A transfer belt unit according to claim 1, wherein the first detection roller and the second detection roller are provided to be movable in the width direction of the transfer belt.

7. A transfer belt unit according to claim 6, wherein the first detection roller and the second detection roller move in the width direction of the transfer belt according to the rotation transmitted by the first transmitting portion.

8. A transfer belt unit according to claim 4, wherein the transfer belt unit moves the first detection roller to the second detection roller side according to the rotation of the first detection roller and moves the second detection roller to the first detection roller side according to the rotation of the second detection roller.

9. A transfer belt unit according to claim 1, wherein the transfer belt includes ribs in inner peripheries at the ends in the width direction, the first detection roller rotates according to contact with the rib at the first end, and the second detection roller rotates according to contact with the rib at the second end.

10. A transfer belt unit according to claim 9, wherein a rotation amount of the first detection roller is changed according to a force of contact with the rib at the first end, and a rotation amount of the second detection roller is changed according to a force of contact with the rib at the second end.

11. A transfer belt unit according to claim 1, wherein the first detection roller rotates according to contact with the inner periphery at the first end of the transfer belt, and the second detection roller rotates according to contact with the inner periphery at the second end of the transfer belt.

12. A self-steering method for a transfer belt, comprising:

rotating a rear-side detection roller according to contact with a rear side of a transfer belt rotated to travel and rotating a front-side detection roller according to contact with a front side of the transfer belt;

transmitting a first rotation by the rear-side detection roller or a second rotation by the front-side detection roller to a lead screw;

transmitting a rotation by the lead screw to a rack pinion mechanism;

tilting the steering roller in a travelling direction of the transfer belt according to a rotation by the rack pinion mechanism; and correcting a travelling direction of the transfer belt according to a tilt of the steering roller in the travelling direction of the transfer belt.

13. A self-steering method for a transfer belt according to claim 12, wherein the steering roller tilts, according to the first rotation, to move the transfer belt to the rear side and tilts, according to the second rotation, to move the transfer belt to the front side.

14. A self-steering method for a transfer belt according to claim 12, further comprising moving the rear-side detection roller to the front side according to the first rotation and moving the front-side detection roller to the rear side according to the second rotation.

15. A self-steering method for a transfer belt according to claim 12, further comprising transmitting the first rotation and the second rotation to the steering roller using a lead screw.

16. A self-steering method for a transfer belt according to claim 12, further comprising transmitting the first rotation and the second rotation to the steering roller using a worm and a worm wheel.

17. An image forming apparatus comprising:

a transfer belt that is rotated to travel;

a printer unit configured to form a toner image on a sheet via the transfer belt;

a driving roller configured to rotate the transfer belt;

a first detection roller that rotates in contact with a first end in a width direction of the transfer belt;

a second detection roller that rotates in contact with a second end opposed to the first end of the transfer belt;

a first transmitting portion that includes a lead screw which is rotated according to a rotation of the first detection roller or the second detection roller and a rack pinion mechanism which is connected to the lead screw and is rotated in a direction perpendicular to the rotation of the first detection roller or the second detection roller, and is configured to transmit the rotation of the first detection roller or the second detection roller;

a steering roller that is connected to the rack pinion mechanism and tilted in a traveling direction of the transfer belt, and is configured to change a direction of the rotation and traveling of the transfer belt according to a rotation of the first detection roller or the second detection roller; and a steering supporting member configured to support the steering roller and being tilted in a traveling direction of the transfer belt together with the steering roller.

* * * * *